United States Patent [19]

Sherwick et al.

[11] 4,324,058

[45] Apr. 13, 1982

[54] METHOD OF LABELING UNDERSIZED CONTAINERS

[75] Inventors: Steven P. Sherwick, Minnetonka; David G. Leapley, St. Louis Park, both of Minn.; James P. Vonderhorst, Parkton, Md.

[73] Assignee: Accraply, Inc., Minnetonka, Minn.

[21] Appl. No.: 125,208

[22] Filed: Feb. 27, 1980

[51] Int. Cl.[3] ..... G09F 3/00

[52] U.S. Cl. ..... 40/310; 40/306; 40/2 R; 40/21 B

[58] Field of Search ..... 40/310, 306, 2 R, 21 B, 40/21 R

[56] References Cited

U.S. PATENT DOCUMENTS

| | | | |
|---|---|---|---|
| 1,756,944 | 5/1930 | Gorton | 40/306 |
| 1,896,834 | 2/1933 | Brown | 40/306 |
| 3,077,684 | 2/1963 | Gwinn | 40/21 R |
| 4,128,954 | 12/1978 | White | 40/306 X |

FOREIGN PATENT DOCUMENTS

| | | | |
|---|---|---|---|
| 342465 | 12/1959 | Switzerland | 40/306 |
| 1510638 | 5/1978 | United Kingdom | 40/310 |

*Primary Examiner*—Gene Mancene
*Assistant Examiner*—John J. Wilson
*Attorney, Agent, or Firm*—Oldham, Oldham, Hudak & Weber

[57] ABSTRACT

A label for undersized containers is disclosed, the label having a portion to contact the circumference of the container and portions to overlap and engage themselves. The overlap portion may be releasably attached to that portion of the label which has previously been attached to the container. A label of this nature is used for undersized containers or containers which may be economically reduced now that the information previously displayed on the container may be placed on the label of the present invention.

2 Claims, 3 Drawing Figures

METHOD OF LABELING UNDERSIZED CONTAINERS

BACKGROUND OF THE INVENTION

Heretofore, the containers in commerce have traditionally expressed and displayed information regarding the type of container and the properties of the contents within the container. While this information has been adequately displayed on some containers where size of the container is not determinative, many containers are limited by size or shape without regard to the information necessary to be displayed thereon. Moreover, with increased requirements by government to adequately inform the consuming public about the nature of the contents within the container, increasing amounts of information must be displayed on a container exterior. While this additional information is required, it is extremely expensive to resize containers merely to provide the additional information.

Consequently, a need exists for a label which accomplishes the purposes of providing significant space for information regarding the contents of the container without increasing the size of the container beyond the limits of packaging and economy. Furthermore, a need exists for the establishment of a label which may be applied to containers of standard dimensions to eliminate an additional cost of expanding the container merely to meet the informational requirements of the product.

OBJECTS OF THE INVENTION

Therefore, it is an object of this invention to provide a label to be used with containers having an undersized outer circumference, relative to the amount of information necessary to meet consumer and governmental demands.

It is another object of the invention to provide a label which may provide more information than the outer circumference of the container may permit under standard container dimensions.

It is another object of the invention to provide a label which may permit the size of the container to be reduced when convenient, the amount of information displayed thereon remaining constant.

It is yet another object of the invention to provide a method for labeling a container with more information than the outer circumference of the container may permit, by overlapping the label beyond the outer circumference of the container and wrapping the overlap portion around the outer circumference of the container.

Yet another object of the invention is to provide a method for labeling a container with more information than the outer circumference of the container may permit, wherein the label may have printed information on substantially all portions of the exposed surface of the label.

These and other objects of the invention, which will become more apparent as the detailed description of the preferred embodiment proceeds, are achieved by: a label product for application to containers requiring information printed thereon, comprising: a label having a length, an outer circumference contact portion substantially centered on said label length equal to the outer circumference of the container, two overlap portions flanking said container portion, and a release portion and a releasable adhesive portion, each flanking one said overlap portion; all said portions having an exposed surface and an adhesive surface, said adhesive surface of said outer circumference contact portion attachable to the outer circumference of the container, said adhesive surfaces of both said overlap portions attachable to each other, said adhesive surface of said release portion attachable to a segment of said releasable adhesive portion, and the remainder of said adhesive surface of said releasable adhesive portion releasably attachable to said exposed surface of said outer circumference contact portion.

The objects of the invention are further achieved by: a method to label a container with more information than the outer circumference of the container may permit, comprising: (a) attaching a label to the outer circumference of the container, said label having a length, an outer circumference contact portion substantially centered on said label length equal to the outer circumference of the container, two overlap portions flanking said outer circumference contact portion, and a release portion and a releasable adhesive portion, each flanking one said overlap portion, all said portions having an exposed surface and an adhesive surface; (b) attaching said adhesive surfaces of said overlap portions to each other and said adhesive surface of said release portion to a segment of said adhesive surface of said releasable adhesive portion; (c) wrapping said attached overlap portions around the outer circumference of the container; and (d) releasably attaching the remainder of said adhesive surface of said releasable adhesive portion to said exposed surface of said outer circumference contact portion.

DESCRIPTION OF THE DRAWINGS

For an understanding of the scope of the invention and its application to containers, reference is had to the following drawings, wherein.

DETAILED DESCRIPTION OF THE PREFERRED EMBODIMENT

Figure 1:
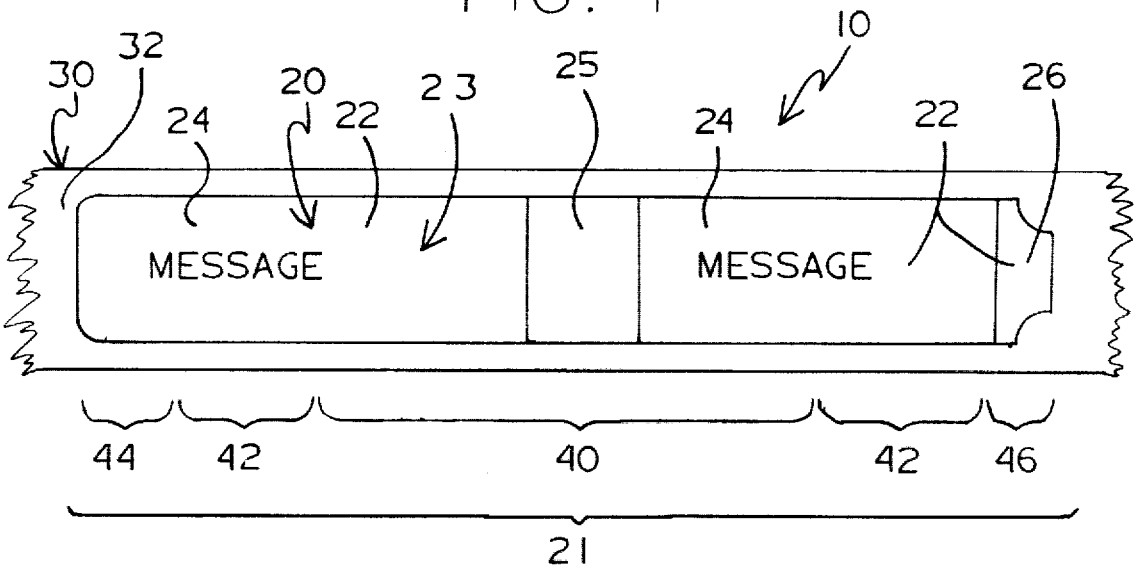
FIG. 1 is a top view of the label stored on a backing surface.
Figure 2:
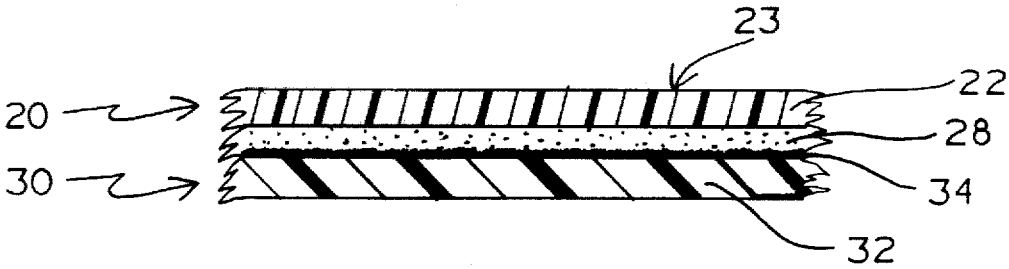
FIG. 2 is a cross-sectional view of the label stored on the backing surface.

For an understanding of the scope of the label of the present invention, reference is had to FIGS. 1 and 2. The label system, generally denominated as 10, of the present invention is seen in FIG. 1 to be a label, generally shown as 20, releasably attached to a storage backing, generally shown as 30. By the examination of FIG. 2, it is seen that the label 20 and the storage backing 30 are composed of two layers each. Label 20 is composed of a label substrate 22 and an adhesive layer 28. Storage backing 30 is composed of a backing substrate 32 and a release layer 34 substantially in contact with the adhesive layer 28 of layer 20.

The backing substrate 32 and the release layer 34 are made from materials conventionally employed for storage backing. Backing substrate 32 may use various common materials or films such as Kraft paper, polyethylene-coated, polyephylene film, polyester films, polyvinyl films, polypropylene films, and the like. Likewise, the release layer may utilize any conventional material suitable for that purpose known to those skilled in the art such as silicone-based materials.

The labels substrate 22 is chosen from materials known to those skilled in the art for serving as a substrate to an adhesive material as well as a printing surface. Materials commonly known to those skilled in the art include glossy paper, dull paper, foils, films, Krome-Kote, and any of the materials used for backing substrate 32 which may be printed upon.

The adhesive layer 28 may be a pressure sensitive adhesive or any conventional adhesive which permanently secures two materials, including epoxy, polyurethane, neoprene, nitrile, and silicone-type adhesives. With the exception of releasable adhesive portion 44, the adhesive layer 28 may utilize any of these conventional adhesives, but it is preferred to use a pressure sensitive adhesive layer 28. For releasable adhesive portion 44 and in the preferred embodiment for the entire adhesive layer 28, the pressure sensitive layer is composed of materials such adhesives containing an acrylic base, a rubber base, and the like. The adhesive layer 28 in the preferred embodiment may be applied to the label substrate 22 in any common or conventional manner, such as through calendering, coating, or the like.

Referring again to FIG. 1, an understanding of the various portions of the label 20 may be obtained. Throughout the entire length 21 of label 20, these portions are divided relative to the outer circumference of a container. Outer circumference contact portion 40 is substantially centered along the length 21 of label 20. Flanking outer circumference contact portion 40 are two overlap portions 42 of substantially similar length. Further, flanking one overlap portion 42 is the releasable adhesive portion 44 described above, and flanking the other overlap portion 42 is a release portion 46 in the form of a tab.

Figure 3:
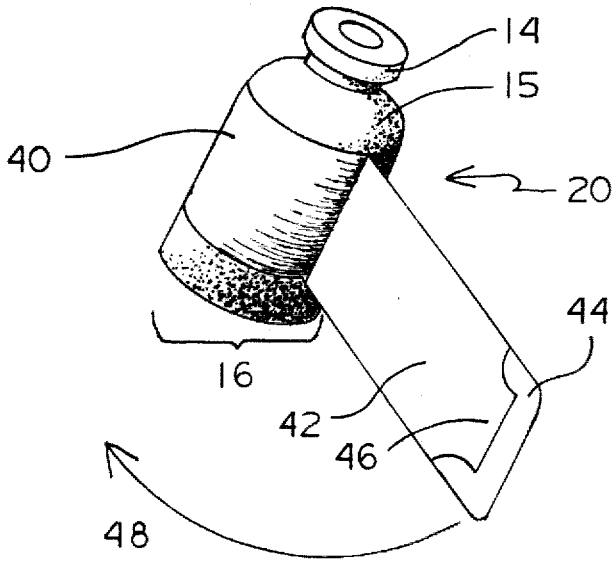
FIG. 3 is an illustrative view of the attachment of the label to an undersized container.

Referring to FIG. 3, the application of label 20 to container 14 is demonstrated. Container 14 has an outer surface 15 having a measureable outer circumference 16. The outer circumference contact portion 40 is attached to the outer surface 15, the length of outer circumference contact portion 40 equal to the measured outer circumference 16 of the container 14. The flanking overlap portions 42 are attached to each other and a segment of the releasable adhesive portion 44 attaches to the release or tab portion 46. The overlap portions 42, the releasable adhesive portion 44, and the release or tab portion 46 are wrapped in a direction 48 which permits the remainder of the releasable adhesive portion 44 to engage the outer circumference contact portion 40 on the outer surface 15 of the container 14. In such manner, the label length 21 greatly exceeds the size of outer circumference 16 of container 14, but is so wrapped so as to provide a releasably attached label 20.

Referring again to FIG. 1, it is apparent that the label 20 having a length 21 may efficiently utilize the space provided for the printing of information thereon. Label substrate 22 has an exposed surface 23 for such purpose. This exposed surface 23 is divided into three areas: a message area 24 located in two different places along an exposed surface 23, a releasable contact area 25, and an overlap contact area 26 substantially in conformence with release portion 46. In the message area 24, all of the information required by government and needed by consumers and purchasers may be placed legibly thereon without regard to the size of the outer circumference 16 of the container 14 being used. This message area may include information identifying the contents of the container 14, the storage requirements, the instructions for concentrated or diluted use, warnings of potency, identification of manufacturer, lot numbers, expiration dates, and the like.

The releasable contact area 25 has been shown in FIG. 1 to be interspaced between two message areas 24. This contact area 25 is merely for illustrative purposes to denote an area within which the releasable adhesive portion 44 contacts when overlap portions 42 are wrapped around the outer circumference 16 of the container 14. The contact area 25 may have additional information printed thereon, or a continuation of the information of message areas 24. Because of the material used for label substrate and the releasable adhesive characteristics of adhesive portion 44, the releasable contact area 25 may withstand repeated attachment and separation of portion 44 when information within the wrapped segments of the label 20 need to be read.

It is conceivable that information may be printed on the overlap contact area 26, but it is preferred that no information be printed in release portion 46 because of its odd shape for legibility requirements. The release portion 46 leaves some area of the releasable adhesive portion 44 exposed when the portions are operatively engaged as shown in FIG. 3. However, if release portion 46 takes a different shape to provide exposure of releasable adhesive portion 44, the information may also be printed in that area 26.

Label 20 of the present invention may be used in a labeling system 10 for containers 14 that are undersized relative to the requirements of information which must be conveyed with the transfer of the container 14 and its contents. In the medicinal or pharmaceutical field, many chemicals must be stored in minuscule containers because of their reactivity or self-degradation in large volumes. These containers 14 in the medicinal and pharmaceutical fields have contents which are the very chemicals which require extensive information as prescribed by government regulation and consumer need. It has been found that all of the information required or needed, when placed on a container 14 having a limited outer circumference 16 yields printed information which is not legible without right lighting and patient concentration. Therefore, the information may be printed in larger type on label 20 because the exposed surface 23 of label 20 has been enlarged by the combination of both overlap portions 42.

In those areas where the size of the container itself has been determined by the amount of information to be printed thereon, the size of the container may be so reduced when label 20 is attached thereon. In this case, the incidental requirements of information may return to their proper perspective and the factors of economic and efficient storage and handling may be restored to their proper position. Indeed, any container size dictated by the amount of information to be printed thereon, may be used when employing label 20 of the present invention.

It is to be understood that the size and shape of the message area 24 on exposed surface 23 may vary according to the requirements of the particular container 14. For example, as the size of outer circumference 16 of container 14 varies, the point at which releasable adhesive portion 44 engages releasable contact area 25 varies along message area 24. Further, the point of contact between portion 44 and area 25 is determined by the length of overlap portions 44 as attached together.

While in accordance with the patent statutes, the best mode and preferred embodiment of the invention has been disclosed, the invention is not to be limited thereto or thereby. Consequently, for an understanding of the scope and breadth of the invention, reference is had to the following claims.

What is claimed is:

1. A method to label a container with more information than the outer circumference of the container may permit, comprising:

(a) attaching a label to the outer circumference of the container, said label having a length, an outer circumference contact portion substantially centered on said label length and being substantially equal to the outer circumference of the container, two overlap portions flanking said outer circumference contact portion and a release portion and a releasable adhesive portion, each flanking one said overlap portion, said contact portion being attached to the outer circumference of the container, all said portions having an exposed surface and an adhesive surface;

(b) attaching said adhesive surfaces of said overlap portions to each other and said adhesive surface of said release portion to a segment of said adhesive surface of said releasable adhesive portion;

(c) wrapping said attached overlap portions around the outer circumference of the container; and (d) releasably attaching the remainder of said adhesive surface of said releasable adhesive portion to said exposed surface of said outer circumference contact portion.

2. A method to label a container with more information than the outer circumference may permit as in claim 1, further comprising the step of:

printing information regarding the container and its contents in a message area on said exposed surface, said message area located on said outer circumference contact portion and both said overlap portions.

* * * * *